United States Patent [19]

Hall et al.

[11] Patent Number: 4,753,355

[45] Date of Patent: Jun. 28, 1988

[54] HANGER STORAGE ASSEMBLY

[75] Inventors: Keith E. Hall, King County; Anna-Leena Dove; Sandra B. Crane, both of Snohomish County, all of Wash.

[73] Assignee: Interstore Transfer Specialists, Inc., Edmonds, Wash.

[21] Appl. No.: 859,420

[22] Filed: May 2, 1986

[51] Int. Cl.[4] ..... A47F 5/08

[52] U.S. Cl. ..... 211/105.1; 211/7; 211/124

[58] Field of Search ..... 211/124, 7, 123, 4, 211/8; 70/59, 62

[56] References Cited

U.S. PATENT DOCUMENTS

| | | |
|---|---|---|
| 744,819 | 11/1903 | Thomas . |
| 1,233,576 | 7/1917 | Higgins . |
| 1,375,553 | 4/1921 | Brazeau . |
| 1,432,589 | 10/1922 | Brazeau . |
| 1,695,517 | 12/1928 | Waldbauer . |
| 1,728,919 | 9/1929 | Batts . |
| 2,068,451 | 1/1937 | Elmore . |
| 2,276,659 | 3/1942 | Fried . |
| 2,685,962 | 8/1954 | Druth . |
| 2,868,390 | 1/1959 | McCrone . |
| 3,021,958 | 2/1962 | Winkler . |
| 3,112,027 | 11/1963 | Field et al. . |
| 3,283,914 | 11/1966 | Robinson . |
| 3,298,503 | 6/1965 | Field et al. . |
| 3,306,465 | 2/1967 | Brennan . |
| 3,317,055 | 5/1967 | Roscicki . |
| 3,419,154 | 12/1968 | Shapiro et al. . |
| 3,458,051 | 7/1969 | Zeman et al. . |
| 3,472,385 | 10/1969 | Shapiro et al. . |
| 3,519,139 | 7/1970 | Brennan . |
| 3,581,905 | 6/1971 | Shapiro ..... 211/7 |
| 3,610,423 | 10/1971 | Parillo . |
| 3,613,898 | 10/1971 | Brennan . |
| 3,868,906 | 3/1975 | Cameron . |
| 3,921,814 | 11/1975 | Solomon . |
| 4,037,728 | 7/1977 | Cameron . |
| 4,079,840 | 3/1978 | Usner . |
| 4,348,145 | 7/1982 | Cameron . |
| 4,494,896 | 1/1985 | DiFranco . |

FOREIGN PATENT DOCUMENTS

| | | |
|---|---|---|
| 176150 | 2/1953 | Austria . |
| 1299385 | 7/1969 | Fed. Rep. of Germany . |
| 894811 | 4/1962 | United Kingdom . |
| 2044094 | 10/1969 | United Kingdom . |
| 2033741 | 5/1980 | United Kingdom . |

*Primary Examiner*—Robert W. Gibson, Jr.
*Attorney, Agent, or Firm*—Seed and Berry

[57] ABSTRACT

A hanger storage assembly for handling garment hangers and the like is described including an elongated hanger bar for receiving and supporting the hangers and an elongated retainer bar that is positionable adjacent the hanger bar to engage and secure the hanger hooks interposed therebetween along the length of the hanger bar. The retainer bar is slidably mounted upon supporting members projecting from the hanger bar, each including a biasing spring to positon the retainer bar in adjacent, spaced, parallel alignment away from the hanger bar to allow access for loading. The assembly also includes a latch pair that engages and secures the retainer bar in a hanger-clamping position to hold the hangers on the hanger bar. The latch is releasable, allowing the biasing spring to slidably reposition the retainer bar for loading or unloading. The hanger bar is provided with ends caps which fit into a rack having retaining clips that support the hanger bar and prevent it from rotating. In the typical arrangement, the supporting elements are fixed to the hanger bar such that the retainer bar elevates upwardly clear of the hanger bar for loading upon release of the latching members. The retainer bar is locked, clamping the hangers onto the hanger bar, by pushing the retaining bar into contact with the hangers. The latch assembly includes a resilient member that has surfaces that engage the retainer bar and hold it in place in opposition to the biasing spring until the latch resilient members are pressed clear of engagement with the retainer bar.

26 Claims, 3 Drawing Sheets

FIG. 1
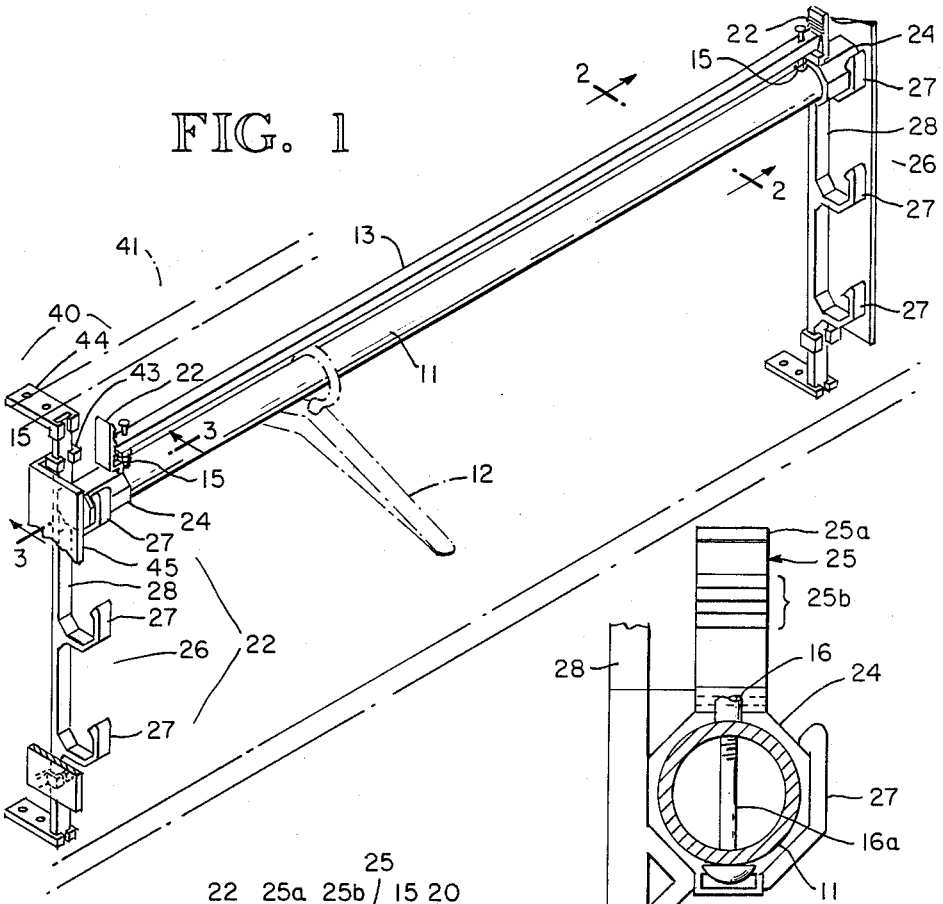
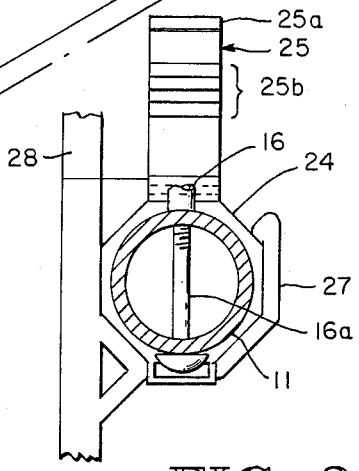
FIG. 2
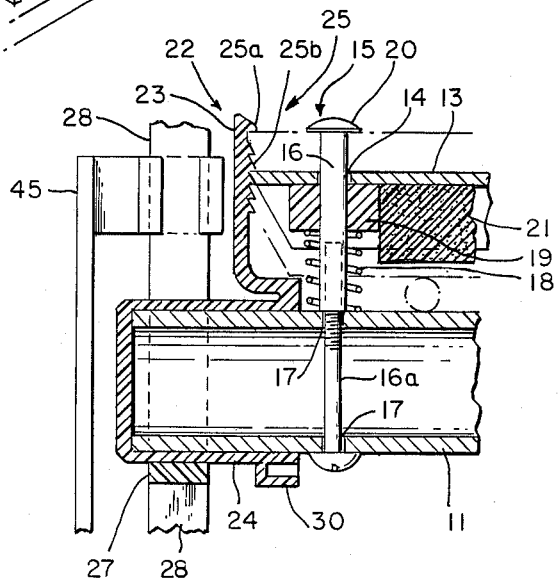
FIG. 3

HANGER STORAGE ASSEMBLY

TECHNICAL FIELD

The present invention relates to an apparatus for managing garment hangers, particularly in commercial settings relating to manufacturing, transporting, selling and distribution of garments and the like.

BACKGROUND OF THE INVENTION

Many garments are finished, transported, distributed and sold while mounted upon a hanger. Management of these hangers, particularly at the store distribution center and garment sales point is time consuming, distracting, and often creates a difficult storage problem. The typical triangular-shaped hanger, including a top hook, is simply an awkward article to handle. In quantity, the hangers tend to become entangled, and in any case, are difficult to stack in any organized manner. Many stores handle a variety of shapes and sizes, further adding to the inconvenience.

A number of hanger racks have been developed to organize and store hangers. Most of the devices contemplate handling the hangers while holding a garment. Very few of the known devices are suitable for managing large quantities of empty hangers. A conventional design includes a hanger bar that receives the hanger hook and a keeper or retainer bar that bears upon and holds the hanger onto the hanger bar. Various means are provided to fasten the keeper bar to the hanger bar and latch it into securing contact with the hangers on the bar.

A key feature of hanger storage devices relates to the latching means and how they cooperate to allow access to the hanger bar for loading/unloading. For example, Cameron in U.S. Pat. Nos. 3,868,906, and 4,348,145 describes a hanger-retaining strip from which a pair of latches project, received by openings in a hanger bar. The retainer strip may be latched in either an elevated position allowing access to the hanger bar for loading or a position where the strip bears on the hanger bar to secure the hangers in place. The hanger bar is provided with end means and mounted such that it pivots about its axis. Thus, when the retainer strip is elevated into the access position, gravity causes the over-balanced hanger bar to rotate whereby the retainer strip falls into a position below the hanger bar, allowing free access to the bar for loading. Such a mechanism requires that the hanger bar ends always be free for rotation, rendering the system somewhat unstable overall. Opening the latching mechanism thus generally requires that the operator use both hands.

GB No. 2,033,741 and GB No. 2,044,094 both describe a retainer bar that is fixed in spaced parallel alignement adjacent the hanger bar. The hanger bar ends are secured to, for example, the walls of the transporting vehicle, by means of a pair of sockets, one of which includes a pin for initially fixing the hanger bar with the retainer bar uppermost to allow loading. The bar is then unpinned, rotated axially until the rotating retainer bar bears against the hanger hook thus securing the hangers on the hanger bar.

Roscicki in U.S. Pat. No. 3,317,055, describes a hanger organizer having a channel-shaped retaining bar that is secured to the hanger bar by means of a single stud and a wing nut. A spring element between the two bars biases the retaining bar in a releasing position. Tightening the wing nut overcomes the spring means and urges the channel edge portions into securing contact with the hangers on the organizer. The two ends of the organizer are unsupported, rendering the organizer somewhat unstable for loading and unloading.

Several of the garment handling devices include design aspects similar to the hanger organizers, but are principally concerned with garment-related problems such as securing garments from theft. For example, Parillo, in U.S. Pat. No. 3,610,423 and Shapiro et al. in U.S. Pat. No. 3,472,385, employ key-locked retainer bars that include means for biasing the retainer bar in a raised position when unlocked. These devices are rather large and heavy and the latching system is not suitable for ready access where the emphasis is upon managing large numbers of hangers rather than garments.

DISCLOSURE OF THE INVENTION

The invention provides a hanger storage assembly that is useful for securing, holding, transporting and storing empty hangers in an organized manner. The storage assembly of the invention is particularly advantageous for use at the retail sales store level where hanger configurations are varied and storage space typically limited. The invention also provides a hanger storage assembly that is easy to access for loading, even single-handedly, because of its inherent stability.

The hanger storage assembly of the invention includes an elongated hanger bar that receives and supports hook-type hangers and an elongated retainer bar that engages and secures the hangers onto the hanger bar along its length. The retainer bar includes a plurality, typically a pair, of supporting members fixed to and extending from the hanger bar that slidably guide and support the retiner bar between a position away from the hanger bar and a position near the hanger bar that secures and clamps the interposed hanger hooks onto the hanger bar. A biasing means, such as a spring, biases the retainer bar in a disengaged position, displaced from the hanger bar to allow loading access. Latch means, preferably near each end of the hanger bar, each includes a latch member that is resiliently biased to engage and hold, typically by means of serrated surfaces, the retainer bar into securing contact with the hangers on the hanger bar, in opposition to the retainer bar support biasing means. The latching means is multipositional to allow easy loading access and accommodate hangers having varying hook diameters. The latch is releasable by pressing the latch-engaging surface clear of engagement with the retainer bar, resulting in the biased retainer bar moving to its disengaged position.

The hanger bar is preferably fitted with a pair of end caps that have exterior surfaces for engaging supporting surfaces that prevent the hanger bar from rotating and hold the hanger bar, retainer bar and latches in fixed alignment. Supporting surfaces for engaging the end caps are preferably resilient clips that securely hold the end caps and prevent the hanger from rotating. The clips may be mounted upon a pair of supporting brackets. The bracket pair is spaced apart and a pair of clips horizontally aligned to engage and secure the hanger bar caps, such that the hanger storage assembly is substantially horizontally supported during loading. A plurality of bracket clip pairs are typically mounted on the supporting brackets forming a rack upon which a number of hanger storage bars may be stacked in vertical array. The hanger bar caps and bracket clips are both preferably of a polygonal cross-section that prevents the hanger bar from rotating and orients the locking bar as desired when supported by the rack brackets. The hanger storage assemblies are secured to the brackets by including a stop on each cap for engaging an inner surface of each clip.

The brackets may be fitted with a mounting bracket that facilitates vertical installation of the rack. The mounting bracket includes a channel which engages the bracket base and extends adjacent horizontal supporting surfaces such as the underside of a wrapping counter and a shelf or floor. The channel end adjacent the horizontal supporting surface receives an angle bracket for fastening to the supporting surface. The mounting bracket also includes a surface which engages the exterior ends of the hanger bar caps and further engages the supporting surfaces at its ends, lending stability to the rack.

In a preferred embodiment, each retainer bar supporting and guiding member is fixed substantially perpendicularly to the hanger bar, in alignment with a retainer bar aperture that slidable receives the guide. A spring is mounted on the guide between the hanger and retainer bars to bias the retainer bar in the disengaged position. A stop on the guide, exterior to the retainer bar, limits the biased displacement to just that necessary to accommodate easy loading access to the hanger bar.

A preferred embodiment also includes latches that are fixed to the hanger bar caps. Each latch is a resilient tab extending, under tension, into engagement with the locking bar while it is in the disengaged position. In a most preferred embodiment, the tab includes serrated surfaces which permit engaging and securing the locking bar in its engaged position with respect to the hangers on the hanger bar. The embodiments of the invention include a number of means for fastening the latching assembly to the hanger bar and engaging the retainer bar.

BRIEF DESCRIPTION OF THE DRAWINGS

FIG. 1 is an isometric projection of the preferred embodiment of a hanger bar and a rack suitable for holding a plurality of hanger storage bars in a stacked array of FIG. 1.

FIG. 2 is a partial sectional view along lines 2—2 showing a hanger bar cap secured in a clip on the rack.

FIG. 3 is a partial sectional view along lines 3—3 of FIG. 1 showing details of the retainer bar and latch assembly.

BEST MODE FOR CARRYING OUT THE INVENTION

Figure 4:
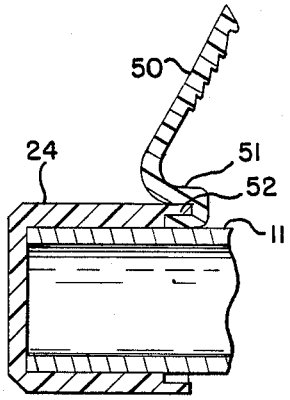
FIG. 4 shows an alternative embodiment of a latching member secured to a hanger bar end cap.

Referring to FIG. 1, the hanger storage assembly 10 of the invention includes a hanger bar 11. The hanger bar is a rigid tube of, for example, less than an inch in diameter, that conveniently engages the hook of a typical triangular or other shaped garment hanger 12. The hanger assembly 10 includes a locking retainer bar 13 for engaging and securing the hangers on the bar 11 during transport. The retainer bar 13 is provided with apertures 14 to accommodate a pair of vertical supporting members 15 that are fixed to the hanger bar. The supporting members each include a guide pin 16 fixed to the hanger bar. The pin is rigidly fixed substantially perpendicularly to the hanger bar by means of a threaded round-headed screw or bolt 16a that passes through hanger bar apertures 17 and threads into internal threads of the pin 16. The guide pin 16 is fitted with a spring 18 that bears on the hanger bar 11 and a stabilizer block 19 that is in contact with the retainer bar 13. The spring 18 biases the retainer bar 13 away from the hanger bar 11 to allow loading access. A retaining ring or cap nut 20 is fitted to the guide pin 16 above the retainer bar 13 to limit extension of the retainer bar into a disengaged position away from the hanger bar that provides sufficient access to easily and conveniently load the bar.

The retainer bar 13 is typically a rigid channel piece fitted with a strip 21 of resilient material such as an open-cell polyurethane to accommodate and secure in place hangers having differing diameter hook portions or configurations. The retainer bar is made of any rigid material, including rigid polymers, metals or compositions. A preferably material is 6063-T6 aluminum which may be anodized to provide an attractive, protective finish.

The retainer bar 13 is held into securing, hanger clamping engagement with the hangers 12 by means of a pair of latches 22, each of which includes a resilient latch member or tab 23 fixed to end caps 24 mounted on the hanger bar 11. The nature of the tab 23 material is such that when the tab is in contact with the retainer bar 13, the tab 23 is under tension, holding and locking the retainer bar 13 in a disengaged position away from the hanger bar or in a position in contact with hangers on the hanger bar. Each latch 22 includes surfaces 25 for engaging the retainer bar. A top projection or tab **25*a* provides a position of maximum distance between the two bars. Serrations 25*b*, each having a horizontal component for engaging and holding the retainer bar in position, extend along the face of the tab 23** to allow adjusting the position of the retainer bar to accommodate loading or securing engagement at any convenient or necessary elevation.

The tension force imposed on the retainer bar is provided by the resilient characteristic of the latching tab material, and forming the tab at an angle directed toward the center of the hanger bar. For example, the tab 23 of a combination tab 23 and cap 24 structure may be made of Celcon ® copolymer and molded such that the tab is angled at about 15 degrees from the vertical to achieve an adequate tensioning.

Referring to FIG. 4, another embodiment of the latching system includes a tab 50, shown disengaged. The tab 50 includes a channel base 51 and is fixed in position on the hanger bar by fixing to a projection 52 of each end cap 24.

In operation, the tabs are pressed back to a substantially vertical position to accommodate the length of the retainer bar such that the bar end engages the serrated surfaces 25*a* or 25*b* of the tab. The tab engages the retainer bar with sufficient tension such that the latches hold the retainer bar in position in opposition to, and overcoming the supporting element 15 biasing spring 19 which tends to urge the locking bar 13 in the disengaged position.

Figure 5:
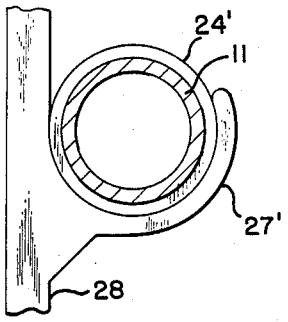
FIG. 5 shows an alternative embodiment of an end cap and a clip each having circular cross-sections.

The hanger and retainer bar assembly 10 is stabilized and prevented from rotation about its axis by the combination of a pair of end caps 24, on which the latch 22 may be mounted, engaging a pair of aligned bracket supports 26 that together constitute a rack that permits stacking a number of hanger bar assemblies in a vertical array. Each end of the hanger bar 11 receives an end cap 24 that is fixed to the hanger bar. The cap is preferably polygonal in exterior cross-section, providing stabilizing bearing surfaces that are engageable to prevent the hanger bar from rotating. Each end cap 24 is engaged by a bracket clip 27 that is mounted on a bracket base 28. The clip 27 receives and conforms to the exterior shape of the end caps 24. Matching and engaging the polygonal cross-sections of the end caps 24' and clips 27' prevents the hanger bar and latching system from rotating out of useful alignment. The clips 27 are typically constructed of a resilient material so that the bar may be rotated upon application of sufficient force, if desired. The end caps 24 and clips 27 may be complementary circular cross-sections, whereby the hanger bar is held in a fixed, non-rotational position by frictional forces between the end caps and clips, as shown in FIG. 5.

The rack of the invention includes a pair of brackets 28 aligned in a vertical plane with bracket clip pairs 27 spaced and aligned to engage a pair of hanger bar end caps 24 to support a hanger bar 11 in a substantially fixed horizontal position for loading. The bracket pair may be mounted upon a supporting base plate (not shown), or otherwise supported by means of framework to stabilize and support the hanger bar assemblies. The brackets 28 typically include a plurality of clip pairs 27, wherein the rack may hold a plurality of hanger storage assemblies in a substantially vertical array.

The hanger bar assembly is secured in contact with the bracket assembly by means of a retaining lug 30 on each end cap 24. A pair of lugs 30 prevents the hanger bar from sliding longitudinally out of the rack, each lug acting as a stop with respect to the interior side of the retaining clip 27.

The rack assembly may be conveniently mounted under a counter, fixed between the underside of the counter top and the floor or a horizontal base surface, such as a shelf. For such mounting, a mounting bracket assembly 40 is provided. Such mounting assemblies include extending each bracket support base 28 adjacent the horizontal supporting surface 41. An L-shaped mounting bracket 42 includes a channel 43 that engages the extended portion of the base 28. The channel 43 also enages a vertical component of an angle bracket 44. The angle bracket 44 horizontal component is fastened to the under surface of the counter top 41. The bottom end of the rack brackets is similarly fastened to a lower horizontal surface. The mounting bracket 42 also includes a surface 45 which helps stabilize the rack, providing support on the horizontal surface 41.

In operation, hanger storage assemblies are received and mounted upon a rack assembly, that has been installed as described above under a sales counter, for example. To load hangers upon an empty hanger bar assembly, assuming the retainer bar is in its hanger securing position, one first presses both latches clear of engagement of the retainer bar. The biasing springs on the retainer bar supporting members cause the retainer bar to elevate into its disengaged position, displaced from the hanger bar to allow loading access. The latches may be pressed either simultaneously or one at a time, permitting single-handed access. The hangers are then placed on the bar and the retainer bar engaged by pressing it downwardly until it satisfactorily engages the hangers in place on the hanger bar. The tensioned tabs and serrated engaging surfaces allow the retainer bar to be closed and secured in place by pressing the bar into contact with the hangers. The completely loaded hanger storage assembly may then be disengaged from its supporting rack by pulling it clear of the resiliently engaging bracket clips for shipping and the like. Alternatively, an entire vertical array of rack mounted hanger assemblies could be detached from its mounting brackets and placed in a container from transportation, for example.

The hanger storage assembly may be made of any materials which have appropriate rigidity, in the case of the supporting and bar members, and resiliency, in the case of the latching elements. The hanger bar and retainer bar may be made of rigid, polymeric materials or metals. A preferred material is an aluminum extrusion of type 6063-T6 composition. The end caps and latching members are preferably injection molded or extruded as a single piece. A preferably material is an acetal copolymer Celcon®, manufactured by Celanese Chemical Company of New York, N.Y. Celcon® is a thermoplastic copolymer that is hard, rigid, strong, and tough, yet resilient.

Figure 6:
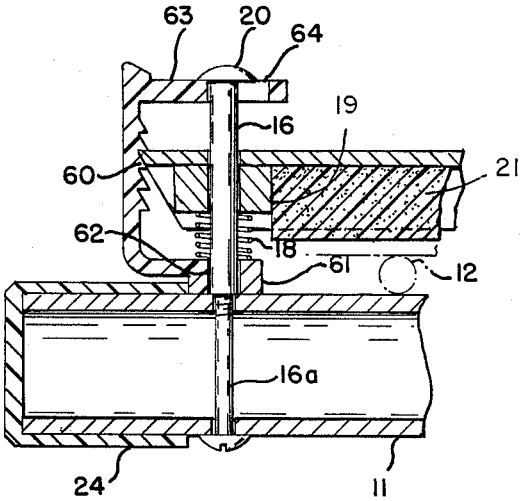
FIG. 6 shows another embodiment of the latching assembly of the invention.

Another embodiment of the latch assembly 22 of the invention is shown in FIG. 6. A resilient latch member 60 includes a base member 61 provided with an aperture 62 that is fitted concentrically over the supporting members 16, 16a. The biasing spring 18 bears upon the base member 61 to force the latch member into fixed contact with the hanger bar 11. The latching member 60 also includes an upper portion 63 that forms a parallel stopping surface for the retainer bar 13. The upper latching portion 63 is provided with an elongated slot 64 through which the supporting members 16 passes. The elongated slot 64 permits pressing the resilient latch member 60 away from engagement with the retainer bar in order to adjust the position of the retainer bar.

Figure 7:
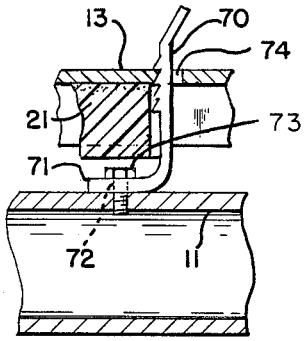
FIG. 7 is yet another embodiment of the latching assembly of the invention.

Yet another embodiment of the latch assembly is shown in FIG. 7. The resilient latch member 70 includes a base portion 71 which contacts the hanger bar 11. The base portion 71 is provided with an aperture 72 and fixed to the hanger bar 11 by means of a fastener 73. The latching member 70 projects upward into latching contact with the retainer bar 13. The retainer bar 13 is provided with an elongated slot 74, preferably intermediate to the length of the retainer bar, to accommodate latching contact with the latching member 70.

Figure 8:
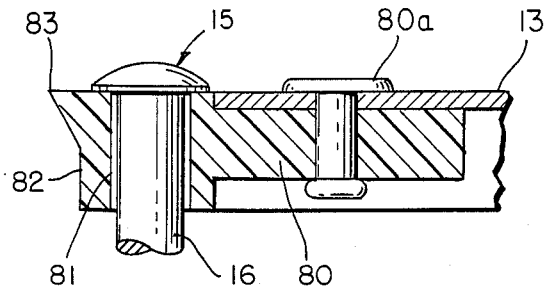
FIG. 8 shows an alternative retainer bar configuration.

The configuration of the retainer bar 13 may be varied to accommodate the various latching systems and for ease in manufacturing and assembly. As shown in FIG. 8, an end fitting 80 may be fixed by means of a fastenera 80*a* to the retainer bar 13 providing an aperture 81 through which the supporting and guiding member 16 passes. An end portion 82 functions as a stabilizer element against which the biasing spring 18 bears, as well as a surface 83 for engaging the latching member (not shown).

Figure 9:
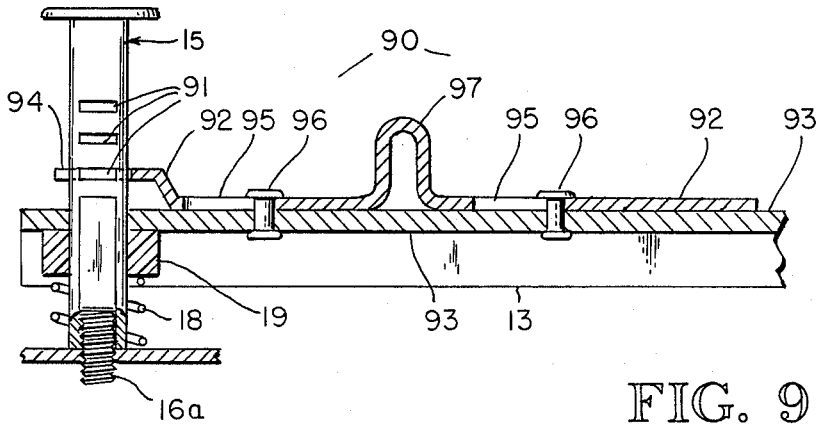
FIG. 9 depicts an alternative latch assembly structure.

Another latching assembly 90 is shown in FIG. 9. The supporting member 15 is fixedly mounted upon the hanger bar 11 by screw 16*a*, as previously described. Also, the biasing spring is mounted concentrically upon the supporting member 15, bearing upon the hanger bar 11 and a stabilizer block 19, urging the retainer bar into a non-clamping position for loading. The supporting member 15 is provided with a plurality of circumferential slots 91 positioned for engagement by a latch member 92 to overcome the biasing spring 18 and clamp hangers securely on the hanger bar 11. The latch member 92 that is mounted upon an upper portion 93 of the retainer bar 13 and includes a slotted end yoke 94 that is capable of engaging the slots 91 on the supporting member 15. The latch member 92 is provided with a pair of elongated slots 95. The latching member 92 is slidably fixed to the retainer bar by means of fasteners 96. A portion of the latching member 92 is raised to form an operating handle 97. In operation, the spring 18 biases the retainer bar 13 in an elevated position away from the hanger bar 11 to allow loading access. The latching member engages the uppermost supporting member slots while in the loading position. Once the hanger bar is loaded, the latching member 92 is slid toward the center of the hanger bar 13 until its slotted yoke end 94 clears the slots 91 of the supporting member 15. The retainer bar 13 is then depressed until it securely clamps the hangers on the bar. The latching member 92 is then slid toward the supporting members 15 until the yoke 94 engages the circumferential slots 91, locking the retainer bar into a clamping position.

Figure 10:
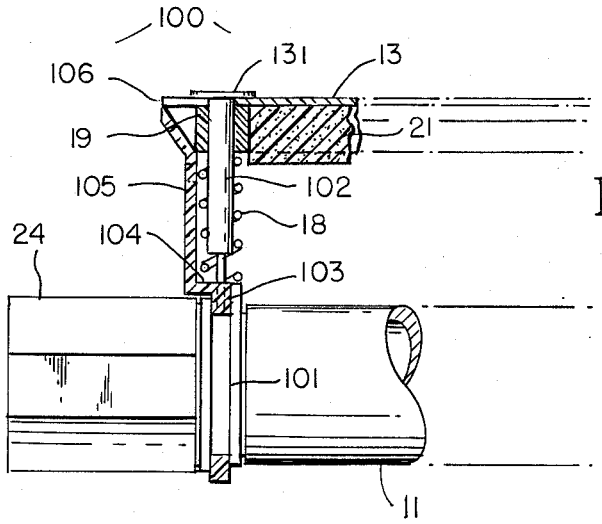
FIG. 10 shows a retainer bar supporting assembly with a supporting members secured to the hanger bar by means of a collar assembly.

Referring to FIG. 10, another embodiment 100 of the retainer bar latching assembly of the invention is shown with the retainer bar is at its uppermost position for hanger loading. The assembly 100 include a circular collar 101 that is fitted concentrically about the hanger bar 11 at each hanger bar end, adjacent the hanger bar end cap 24. A supporting member 102 is fixed to the collar by means of a threaded bolt and receiving screw 103. The supporting member projects from the collar to slidably engage the retainer bar 13. A spring 18 bears upon a lower collar surface 104 and a stabilizer element 19 at the retainer bar 13. The head of the fastener 131 limits the position of the retainer bar away from the hanger bar in opposition to the biasing spring 18. A resilient latching member 105 that is preferably an integral part of the collar 101, projects into tensioned engagement and locking contact with an edge 106 of the retainer bar 13. In operation, the retainer bar, when positioned away from the hanger bar, is rotatable about the hanger bar, since the collar 101 is not otherwise anchored to the hanger bar. Such a position facilitates loading since the hanger bar is entirely clear of the upper portion of the hanger bar. When the hanger bar is loaded with hangers, the retainer bar is rotated into an convenient position to secure the hangers on the hanger bar and then depressed into place. The locking latching member 105 thus engages retainer bar element 106 to securely lock the retainer bar into contact with the hangers onto the hanger bar.

From the foregoing, it will be appreciated that, although embodiments of the invention have been described herein for purposes of illustration, various modifications may be made without deviating from the spirit and scope of the invention. Accordingly, the invention is not limited except as by the appended claims.

We claim:

1. A hanger storage assembly comprising:

an elongated hanger bar that receives and supports the hangers;

an elongated retainer bar positionable adjacent to the hanger bar to engage and secure the hanger hooks interposed therebetween along the length of the hanger bar;

a plurality of supporting members connected to and projecting from the hanger bar that slidable guide and support the retainer bar between a position away from the hanger bar and a position near the hanger bar that secures and clamps the interposed hangers onto the hanger bar;

a biasing means interposed between the hanger bar and retainer bar that urges the retainer bar into a position away from the hanger bar; and a latch means for engaging and securing the retainer bar into the hanger clamping position securing the hangers on the hanger bar, the latch being releasable so that the biasing means urges the retainer bar sliding on the supporting members into a position away from the hanger bar and wherein each latch includes surfaces that resiliently engage and secure the retainer bar in multiple positions away from the hanger bar and in multiple clamping positions, thereby accommodating variations in hangers.

2. A hanger storage assembly comprising:

an elongated hanger bar that receives and supports the hangers;

an elongated retainer bar positionable adjacent to the hanger bar to engage and secure the hanger hooks interposed therebetween along the length of the hanger bar;

a plurality of supporting members connected to and projecting from the hanger bar that slidably guide and support the retainer bar between a position away from the hanger bar and a position near the hanger bar that secures and clamps the interposed hanger hooks onto the hanger bar;

a biasing means interposed between the hanger bar and retainer bar that urges the retainer bar into a position away from the hanger bar; and a latch means for engaging and securing the retainer bar into the hanger clamping position securing the hangers on the hanger bar, the latch being releasable so that the biasing means urges the retainer bar sliding on the supporing members into a position away from the hanger bar, wherein said retainer bar is apertured adjacent each latch, each latch fastened to the hanger bar and including a latch member that projects from the hanger bar through the retainer bar aperture, resiliently engaging the retainer bar, the latch member further including an upper stop that limits the uppermost position of the retainer bar away from the hanger bar and lower surfaces that engage and secure the retainer bar in hanger clamping positions, the securing engagement releasable by pressing the resiliently engaged latch member longitudinally clear of the retainer bar.

3. A hanger storage assembly for hangers of the type including a supporting hook portion, comprising:

an elongated hanger bar that receives and supports the hangers;

an elongated retainer bar positionable adjacent to the hanger bar to engage and secure the hanger hooks interposed therebetween along the length of the hanger bar;

a plurality of supporting members connected to and projecting from the hanger bar that slidable guide and support the retainer bar between a position away from the hanger bar and a position near the hanger bar that secures and clamps the interposed hanger hooks onto the hanger bar;

a biasing means interposed between the hanger bar and retainer bar that urges the retainer bar into a position away from the hanger bar;

a latch means for engaging and securing the retainer bar into the hanger clamping position securing the hangers on the hanger bar, the latch being releasable so that the biasing means urges the retainer bar sliding on the supporting members into a position away from the hanger bar, wherein each latch includes an apertured base, received by and fitted concentrically on the supporting member;

each biasing means includes a spring mounted upon the supporting member, urging the retainer bar away from the hanger bar and urging the base portion of the latch onto said hanger bar; and each latch further including an upper portion projecting above the retainer bar and engaging the top portion of the retainer bar when said bar is biased to its maximum position away from the hanger bar, said portion including a slot to accommodate said supporting member passing therethrough, said slot permitting releasing the latch surfaces that resiliently engage the retainer bar by pressing the latch top portion longitudinally, guided by the supporting member, clear of the retainer bar.

4. A hanger storage assembly for hangers of the type including a supporting hook portion, comprising:

an elongated hanger bar that receives and supports the hangers, wherein each hanger bar end is fitted with an end cap, each cap including exterior surfaces for engaging a pair of bracket clips fixed to a rack wherein the hanger bar so engaged is supported in a substantially non-rotational, horizontal; position;

an elongated retainer bar positionable adjacent to the hanger bar to engage and secure the hanger hooks interposed therebetween along the length of the hanger bar;

a plurality of supporting members connected to and projecting from the hanger bar that slidably guide and support the retainer bar between a position away from the hanger bar and a position near the hanger bar that secures and clamps the interposed hanger hooks onto the hanger bar;

a biasing means interposed between the hanger bar and retainer bar that urges the retainer bar into a position away from the hanger bar; and a latch means for engaging and securing the retainer bar into the hanger clamping position securing the hangers on the hanger bar.

5. A hanger storage assembly for hangers of the type including a supporting hook portion, comprising:

an elongated hanger bar that receives and supports the hangers;

an elongated retainer bar positionable adjacent to the hanger bar to engage and secure the hanger hooks interposed therebetween along the length of the hanger bar;

a plurality of supporting members connected to and projecting from the hanger bar that slidably guide and support the retainer bar between a position away from the hanger bar and a position near the hanger bar that secures and clamps the interposed hanger hooks onto the hanger bar;

a biasing means interposed between the hanger bar and retainer bar that urges the retainer bar into a position away from the hanger bar; and a latch pair that engages and secures the retainer bar into the hanger clamping position securing the hangers on the hanger bar, the latch being releasable whereby the biasing means urges the retainer bar sliding on the supporting members into a position away from the hanger bar, wherein said latches are fixed to said hanger bar caps, each latch comprising a resilient latching member extending, under tension, into engagement with the retainer bar, the latching member including serrated surface that engage and secure the retainer bar in position to secure said hangers on said hanger bar.

6. The hanger storage assembly of claim 4 wherein each cap includes a stop tab that is engageable with an inner surface of a clip, a pair of such stops preventing the hanger bar from moving longitudinally, maintaining the hanger bar in a substantially horizontal fixed position between a clip pair fixed to said rack.

7. The hanger storage assembly of claim 4 wherein said bracket clips and end caps are polygonal in cross-section and said storage assemblies are oriented with said retainer bar vertically upright.

8. The hanger storage assembly of claim 4 wherein said clips and caps are hexagonal in cross-section.

9. The hanger storage assembly of claim 4 wherein said clips and caps are circular in cross-section and said hanger bar is prevented from rotation by frictional forces between said caps and clips.

10. The hanger storage assembly of claim 4 wherein each said hanger bar bracket is provided with a mounting bracket that includes a channel for engaging said base, a surface that engages the exterior ends of said hanger bar caps when said hanger bar is mounted upon said clips, whereby said hanger bars are securely held to said brackets, said mounting bracket receiving an angle bracket for fastening onto a supporting horizontal surface.

11. The hanger storage assembly of claim 5 wherein said retainer bar is shorter in length than said hanger bar such that said latches engage each end of said retainer bar.

12. The hanger storage assembly of claim 4 wherein the latch member includes a base portion having a channel component that securely engages an edge portion of the end cap adjacent said retainer bar.

13. A hanger storage assembly for hangers of the type including a supporting hook portion, comprising:

an elongated hanger bar that receives and supports hangers;

an elongated retainer bar positionable adjacent to the hanger bar with the hanger hooks interposed therebetween to secure the hangers onto the hanger bar along the length of the hanger bar;

a plurality of supporting members connected to and projecting from the hanger bar, that slidably guide and support the retainer bar between a position away from the hanger bar and a position near the hanger bar clamping the interposed hanger hooks onto the hanger bar;

a latch means for engaging and securing the retainer bar into a hanger clamping position; and a pair of hanger bar caps, each receiving an end portion of the hanger bar, the caps including exterior surfaces for engaging bracket clips attached to a supporting surface that securely holds the hanger storage bar in a substantially horizontal, fixed position.

14. The hanger storage assembly of claim 13 wherein said bracket clips and the end caps are polygonal in cross-section and secure the hanger bar in a fixed, horizontal position.

15. The hanger storage assembly of claim 13 wherein said bracket clips and the end caps are circular in cross-section and secure the hanger bar in a fixed horizontal position.

16. A hanger storage assembly for hangers of the type including a supporting hook portion, comprising:

an elongated hanger bar that receives and supports the hangers;

an elongated retainer bar positonable adjacent to the hanger bar with the hanger hooks interposed therebetween to secure the hangers onto the hanger bar along the length of the hanger bar, said retainer bar apertured at each end thereof;

a plurality of supporing members connected to and projecting from a hanger bar through the aperture in the retainer bar, said supporting members slidably guiding and supporting the retainer bar between a position away from the hanger bar and a position near the hanger bar, clamping the interposed hanger hooks onto the hanger bar, said supporting members including a plurality of slots for supporting said retainer bar;

a biasing means that is interposed between the hanger and the retainer bar that urges the retainer bar into a position away from the hanger bar; and a latch means for engaging and securing the retainer bar into a hanger clamping position, each latch including an elongated latch member slidably connected to the retainer bar to engage the slots of the supporting member to lock the retainer bar in a clamped position, the latch member releasable by sliding longitudinally along the retainer bar away from the locking engagement with the supporting member.

17. A hanger storage assembly for hangers including a supporting hook or the like, comprising:

an elongated hanger bar that receives and supports said hangers;

an elongated retainer bar positionable adjacent to the hanger bar with the hanger hooks interposed therebetween to secure the hangers onto the hanger bar along the length of the hanger bar, said bar apertured toward each end thereof;

a pair of end caps fixed to the ends of the hanger bar, each cap including external surface a that are engageable to prevent the hanger bar from rotating and support the bar in a substantially horizontal position;

a collar fitted concentrically upon said hanger bar, adjacent said end cap, said collar rotatable about said hanger bar;

a support member fixed to the collar and projecting through the retainer bar aperture for slidably guiding and supporing the retainer bar between hanger clamping positions and non-clamping positions away from said hanger bar, the supporting member including a fastener that limits the away position of the retainer bar;

a biasing means interposed between the retainer bar and the collar for urging the retainer bar into a position away from the hanger bar; and a resilient latch member projecting from the collar into resilient engagement with the retainer bar, the latch member including surfaces for engaging and locking the retainer bar into hanger clamping positions, the latch releasable by pressing an upper portion of the latching member longitudinally sufficiently to clear the locking surfaces from engagement with the retainer bar, wherein said retainer bar is rotatable about said hanger bar when not in a position clamping hangers securely upon said hanger bar.

18. A hanger storage assembly for hangers of the type including a supporting hook portion, comprising:

an elongated hanger bar that receives and supports the hangers;

an elongated retainer bar positionable adjacent to the hanger bar to engage and secure the hanger hooks interposed therebetween along the length of the hanger bar;

a plurality of supporting members connected to and projecting from the hanger bar that slidably guide and support the retainer bar between a position away from the hanger bar and a position near the hanger bar that secures and clamps the interposed hanger hooks onto the hanger bar;

a latch means fixedly attached to the hanger bar and not to the retainer bar for engaging and securing the retainer bar at an edge thereof into the hanger clamping position securing the hangers on the hanger bar, the latch being releasable.

19. A hanger storage assembly for hangers of the type including a supporting hook portion, comprising:

an elongated hanger bar that receives and supports the hangers;

an elongated retainer bar positionable adjacent to the hanger bar to engage and secure the hanger hooks interposed therebetween along the length of the hanger bar;

a plurality of supporting members connected to and projecting from the hanger bar that slidably guide and support the retainer bar between a position away form the hanger bar and a position near the hanger bar that secures and clamps the interpose hanger hooks onto the hanger bar;

each end of the hanger bar having an end cap attached thereon, the end caps including a latch that resiliently engages and secures the retainer bar in multiple positions.

20. The apparatus according to claim 19 wherein the end cap is secured to the hanger bar by a tight friction fit.

21. The apparatus according to claim 19 wherein the end cap and the latch are a unitary, integral member.

22. A hanger storage assembly for hangers of the type including a supporting hook portion, comprising:

an elongated hanger bar that receives and supports the hangers, wherein each hanger bar end is fitted with an end cap, each cap including exterior surfaces for engaging a pair of bracket clips fixed to a rack wherein the hanger bar so engaged is rotatable to different positions;

an elongated retainer bar positionable adjacent to the hanger bar to engage and secure the hanger hooks interposed therebetween along the length of the hanger bar;

a plurality of supporting members connected to and projecting from the hanger bar that slidably guide and support the retainer bar between a position away from the hanger bar and a position near the hanger bar that secures and clamps the interposed hanger hooks onto the hanger bar;

a biasing means interposed between the hanger bar and retainer bar that urges the retainer bar into a position away from the hanger bar; and a latch means for engaging and securing the retainer bar into the hanger clamping position securing the hangers on the hanger bar, the latch being releasable.

23. The hanger storage assembly of claim 22 wherein the hanger bar is rotatable to a position such that the retainer bar is at an angle with respect to the vertical.

24. The hanger storage assembly of claim 22 wherein the cap cross section is a polygon.

25. The hanger storage assembly of claim 1 wherein the plurality of support members are the latch pair.

26. A hanger storage assembly for hangers including a supporting hook or the like, comprising:

an elongated hanger bar that receives and supports said hangers;

an elongated retainer bar positionable adjacent to the hanger bar with the hanger hooks interposed therebetween to secure the hangers onto the hanger bar along the length of the hanger bar;

a pair of spaced collars fitted upon said hanger bar, said collars rotatable about said hanger bar;

a pair of support members fixed to respective collars including means for slidably guiding and supporting the retainer bar between hanger clamping positions and non-clamping positions away from said hanger bar;

a biasing means interposed between the retainer bar and the collars for urging the retainer bar into a position away from the hanger bar; and means for releasably latching the retainer bar in a clamped position.

* * * * *